US006923866B2

(12) United States Patent
Hoisington et al.

(10) Patent No.: US 6,923,866 B2
(45) Date of Patent: Aug. 2, 2005

(54) APPARATUS FOR DEPOSITING DROPLETS

(75) Inventors: Paul A. Hoisington, Norwich, VT (US); Melvin L. Biggs, Norwich, VT (US); Steven H. Barss, Wilmot Flat, NH (US)

(73) Assignee: Spectra, Inc., Lebanon, NH (US)

( * ) Notice: Subject to any disclaimer, the term of this patent is extended or adjusted under 35 U.S.C. 154(b) by 55 days.

(21) Appl. No.: 10/462,092

(22) Filed: Jun. 13, 2003

(65) Prior Publication Data

US 2004/0250758 A1 Dec. 16, 2004

(51) Int. Cl.[7] ..... B41J 2/06; B05C 11/00

(52) U.S. Cl. ..... 118/680; 118/325; 118/46; 347/55; 347/9; 347/19; 347/75

(58) Field of Search ..... 118/300, 46, 672, 118/680–681, 325; 347/19, 54, 55, 74, 75, 9, 10, 17

(56) References Cited

U.S. PATENT DOCUMENTS

| | | | |
|---|---|---|---|
| 4,106,032 A | 8/1978 | Miura et al. | |
| 4,223,324 A | 9/1980 | Yamamori et al. | |
| 4,591,873 A | 5/1986 | McCann et al. | |
| 4,613,875 A | 9/1986 | Le et al. | |
| 4,937,598 A | 6/1990 | Hine et al. | |
| 4,940,995 A | 7/1990 | Hine et al. | |
| 4,947,184 A | 8/1990 | Moynihan | |
| 4,959,662 A | 9/1990 | Kobayashi | |
| 4,995,940 A | 2/1991 | Hine et al. | |
| 5,065,169 A | 11/1991 | Vincent et al. | |
| 5,155,498 A | 10/1992 | Roy et al. | |
| 5,381,162 A | 1/1995 | Roy et al. | |
| 5,742,313 A | 4/1998 | Hine | |
| 6,281,912 B1 | 8/2001 | Silverbrook | |
| 6,450,627 B1 * | 9/2002 | Moynihan et al. | 347/71 |

FOREIGN PATENT DOCUMENTS

| | | |
|---|---|---|
| EP | 0 604 029 A2 | 11/1993 |
| JP | 3-234539 | 10/1991 |
| JP | 10-138461 | 5/1998 |
| JP | 10-453453 | 6/1998 |
| WO | WO 01/89847 | 11/2001 |

* cited by examiner

*Primary Examiner*—Chris Fiorilla
*Assistant Examiner*—Yewebdar Tadesse
(74) *Attorney, Agent, or Firm*—Fish & Richardson P.C.

(57) ABSTRACT

An apparatus for depositing droplets on a substrate is disclosed. The apparatus includes a support for the substrate, a droplet ejection assembly which includes a pumping chamber, a controller and a source of static pressure to maintain the total pressure in the pumping chamber above a threshold pressure level to avoid rectified diffusion type bubble growth in the pumping chamber. The droplet ejection assembly is positioned over the support for depositing the droplets on the substrate and includes, in addition to a pumping chamber, a displacement member and an orifice that ejects the droplets. The controller provides signals to the displacement member to eject drops.

30 Claims, 5 Drawing Sheets

APPARATUS FOR DEPOSITING DROPLETS

This invention relates to depositing droplets on a substrate.

BACKGROUND

Ink jet printers are one type of apparatus for depositing droplets on a substrate. Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 micron or less, e.g. around 25 microns, are separated at a pitch of 100–300 nozzles/inch, have a resolution of 100 to 3000 dpi or more, and provide drops with a volume of about 1 to 70 picoliters (pl) or less. Drop ejection frequency is typically 10 kHz or more.

Hoisington et al. U.S. Pat. No. 5,265,315, the entire contents of which are hereby incorporated by reference, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink-jet print assemblies are also described in Fishbeck et al. U.S. Pat. No. 4,825,227 and Hine U.S. Pat. No. 4,937,598, the entire contents of which are incorporated by reference.

Printing accuracy is influenced by a number of factors, including the size and velocity uniformity of drops ejected by the nozzles in the assemblies and among multiple assemblies in a printer. The drop size and drop velocity uniformity are in turn influenced by factors such as the dimensional uniformity of the ink paths, acoustic interference effects, contamination in the ink flow paths, and the actuation uniformity of the actuators.

In many ink jet systems, ink is supplied through a supply duct to a pumping chamber which communicates with a nozzle, and ink is ejected periodically from the nozzle by a rapid compression of the volume of the pumping chamber as a result of action by an electromechanical transducer, such as a piezoelectric element. The rapid compression is preceded and/or followed by a correspondingly rapid expansion of the chamber volume. During the expansion portion of the ink drop ejection cycle, the pressure of the ink in the pumping chamber is reduced significantly, increasing the tendency of any air dissolved in the ink within the chamber to grow bubbles on the surface of the chamber. Bubbles tend to grow in that manner, especially at nucleation sites in the chamber such as sharp corners, minute cracks or pits, or foreign particles deposited on the chamber surface, where gases can be retained. If the expansion/compression cycles occur at a sufficiently high frequency, the bubbles can increase in size from one cycle to the next, giving rise to rectified diffusion. The presence of gas bubbles within the pumping chamber prevents application of pressure to the ink in the desired manner to eject an ink drop of selected volume from the nozzle at a selected time, resulting in print quality degradation over time. Rectified diffusion can become more problematic in high quality ink jet systems because such systems tend to employ viscous inks that require higher pressures and frequencies to jet properly.

If the frequency of the pressure oscillations in the pumping chamber is relatively low, nucleation site bubbles are expanded within the pumping chamber, but re-dissolve before the next stroke as shown in FIG. 1. Bubble 20 is formed during an expansion stroke at time D. Later, during a compression stroke at time E, the bubble 22 is now smaller due to increased pressure and due to diffusion of the gas from the bubble back into the fluid of the pumping chamber. In this low frequency scenario, the bubble is dissolved by time F.

If the frequency of the pressure oscillations in the pumping chamber is relatively high, bubbles do not have time to re-dissolve during a compression cycle before being subjected to another expansion cycle. FIG. 2 illustrates how the bubble radius cycles to generally increasing radius over multiple pump cycles. FIGS. 3A–3C illustrate the effect of increasing bubble radius in the pumping chamber. Referring to FIGS. 2–3C, at time G, print element 30 fires droplet 32 during the compression stroke of the pumping chamber 34. Within the pumping chamber 34, with meniscus 33, bubble 36 has radius $R_{36}$. Later, at time H, during a compression stroke, bubble 38 (not shown) has radius $R_{38}$ that will grow even further during the next expansion stroke. Later at point I during an expansion stroke, bubble 40 has grown in size in print chamber 34 with meniscus 42. This process continues as before, producing bubble 44 (not shown) with radius $R_{44}$ and bubble 46 (not shown) with radius $R_{46}$. Finally, a significant bubble volume 48 is created in the pumping chamber. At this point, drop volume and velocity can be reduced or, in extreme cases, jetting can be prevented entirely because the energy that would go into jetting droplets goes instead to compressing the bubble.

Jetting at higher frequencies can be desirable because it increases throughput by allowing for higher line speeds. A primary limitation to operating frequency is the resonant frequency of the ink jet that is determined by the round trip time for a pressure wave in the pumping chamber. Therefore, making the pumping chamber smaller increases the natural frequency of the ink jet and allows higher operating frequencies. Making the nozzle diameter smaller also helps to operate at higher frequency, but this also requires smaller drop volumes. It also possible to jet at higher frequency by reducing the time over which the pressure is applied, but then higher pressures are needed. Typically, acoustic pressures range from about 2 atm below ambient on the expansion stroke and then to about 2–3 atmospheres above ambient during the compression stroke. Rectified diffusion can become more problematic at higher jetting frequencies.

SUMMARY

One aspect of the invention features, in general, an apparatus for depositing droplets on a substrate. The apparatus includes a support for the substrate, a droplet ejection assembly which includes a pumping chamber, a controller and a source of static pressure to raise the total pressure in the pumping chamber above a threshold pressure level to avoid rectified diffusion type bubble growth in the pumping chamber. The droplet ejection assembly is positioned over the support for depositing the droplets on the substrate and includes, in addition to a pumping chamber, a displacement member and an orifice that ejects the droplets. The controller provides signals to the displacement member to eject drops.

In some implementations, the static pressure is greater than about 1.5 atmospheres absolute.

In some implementations, the signals are provided at a frequency greater than about 8000 Hz. In other implementations, the signals are provided at a frequency greater than about 8000 Hz and at static pressures greater than about 1.5 atmospheres absolute.

The droplets ejected may be ink or other suitable droplet-forming material. Substrates may be paper or any other suitable substrate.

The source of pressure may include a pressurized gas. The gas can be filtered to remove particulate matter. Moisture or a vaporized solvent may be added to the gas. The gas may be air or any other suitable gas.

Another aspect of the invention features an apparatus that includes a support for the substrate, a droplet ejection assembly including a pumping chamber, a controller, an enclosure structure and a source of static pressure to raise the total pressure in the pumping chamber above a threshold pressure level to avoid rectified diffusion type bubble growth in the pumping chamber. The droplet ejection assembly is positioned over the support for depositing droplets on the substrate that is on the support. The droplet ejection assembly, in addition to a pumping chamber, includes a displacement member and an orifice that ejects the droplets. The controller provides signals to the displacement member to eject drops. The enclosure structure defines together with the support an enclosed region through which the droplets are ejected onto the substrate. The enclosure structure together with the support also defines an inlet gap and an outlet gap through which the substrate travels. The inlet gap may be from about 0.002 inch to about 0.04 inch. The outlet gap may be from about 0.002 inch to about 0.04 inch.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
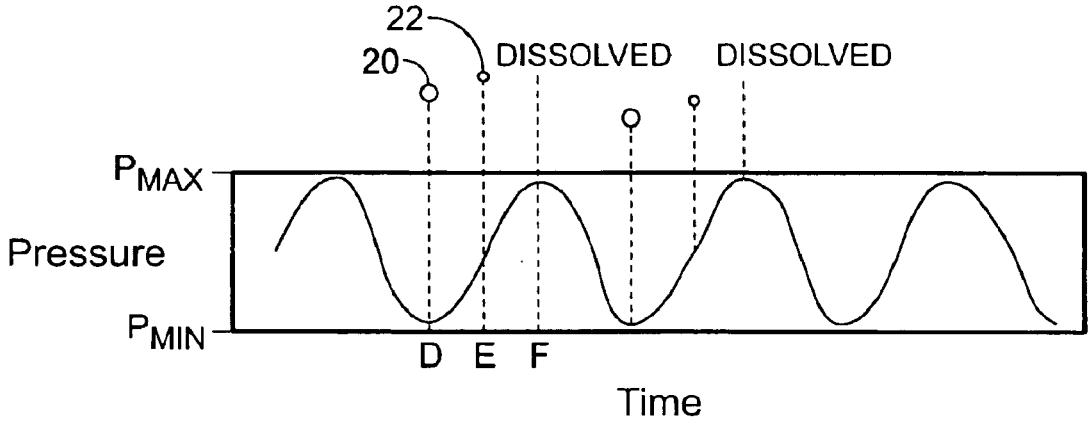
FIG. 1 is graph of ink pressure versus time for a low frequency oscillation case.
Figure 2:
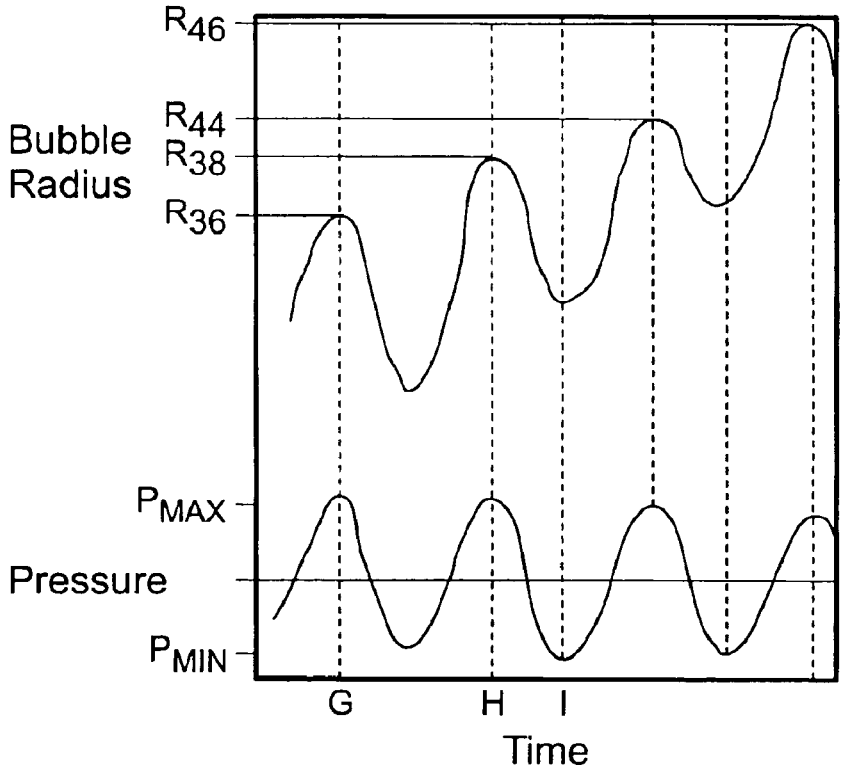
FIG. 2 is a graph of ink pressure and bubble radius versus time for a high frequency oscillation.
Figure 3C:
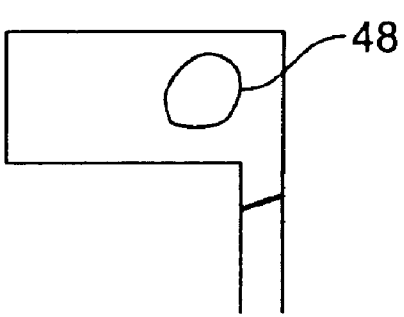
FIGS. 3A–3C illustrate bubble growth in an idealized printhead.
Figure 3B:
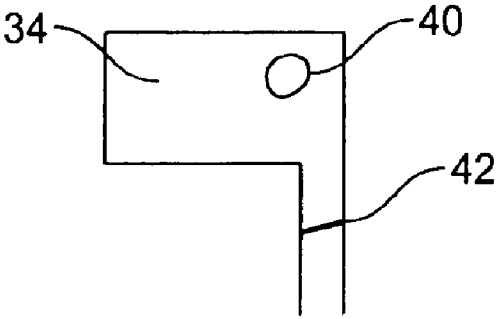
Figure 3A:
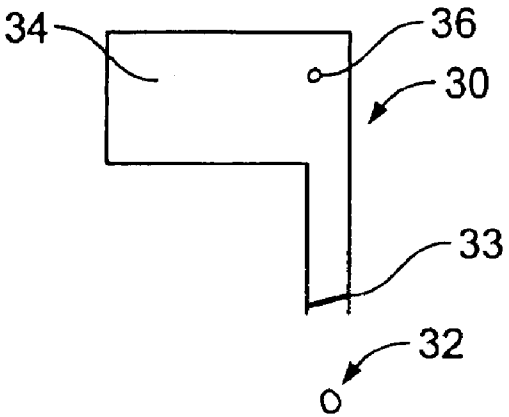
Figure 4:
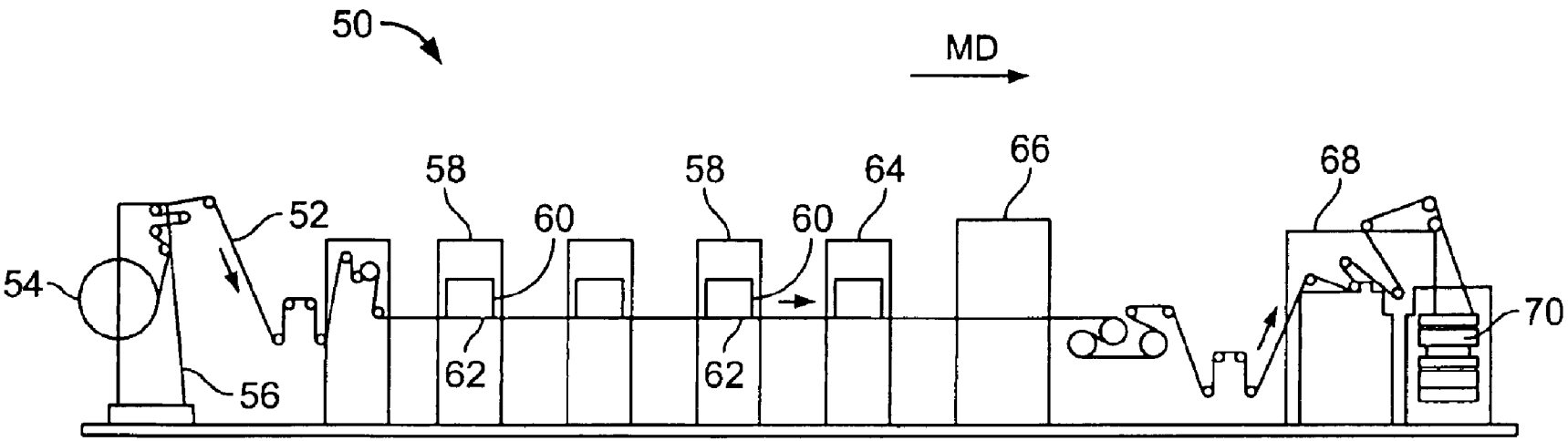
FIG. 4 is a side view of an apparatus for printing on a substrate.

FIG. 4 illustrates apparatus 50 for continuously depositing ink droplets on a substrate 52 (e.g. paper). Substrate 52 is pulled from roll 54 that is on supply stand 56 and fed to a series of droplet-depositing stations 58 for placing a plurality of different colored droplets on substrate 52. Each droplet-depositing station 58 has a droplet ejection assembly 60 positioned over the substrate 52 for depositing droplets on the substrate 52. Below the substrate 52 at each depositing station 58 is a substrate support structure 62 (e.g. a non-porous platen). After the substrate 52 exits the final depositing station 64, it may go to a pre-finishing station 66. The pre-finishing station 66 may be used for drying the substrate 52. It may also be used for UV or other radiation curing of the substrate 52. Next, the substrate 52 travels to the finishing station 68, where it is folded and slit into finished product 70. The substrate feed rate is approximately 0.25–5.0 meters/sec or higher. The droplet ejection assembly may eject droplets of ink. It may also eject a radiation curable material or other material capable of being delivered as droplets.

Figure 5:
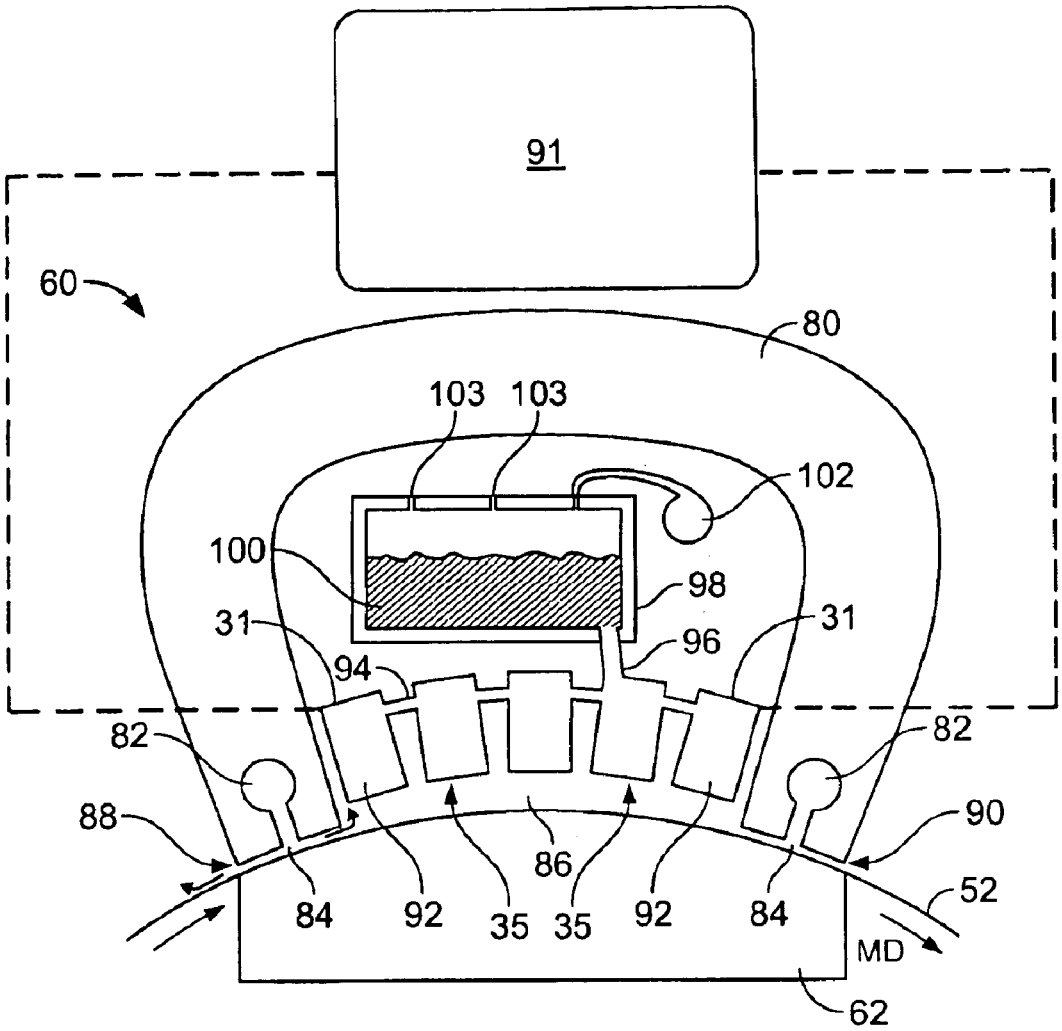
FIG. 5 is a diagrammatic side view of a droplet ejection assembly of the FIG. 4 apparatus.

FIG. 5 shows components of a high frequency droplet ejection assembly 60, comprising a pumping chamber 92, a displacement member 31 and an orifice 35, that is constructed to avoid substantial rectified diffusion. A controller 91, provides signals to displacement member 31 to eject drops. In this device, the total pressure of the ink in the pumping chamber is raised so that the minimum total pressure achieved during the expansion stroke is sufficiently high to avoid rectified diffusion type bubble growth in the pumping chamber. This is achieved by increasing the pressure inside pumping chamber 92 and in the droplet ejection region 86, shown diagrammatically in FIG. 5, by enclosing the printheads, including pumping chambers 92 and source of ink 98, in an enclosure 80 and maintaining the enclosure 80 at an elevated pressure level by pressurized air supplied via manifold 82 through slits 84. Manifold 82 is connected to a compressor with, for example, quick connectors (not shown). Droplet ejection assembly 60 is positioned over a substrate 52 (e.g. paper). A source of static pressure is applied inside enclosure structure 80 via manifolds 82 with slits 84. Pressure applied in this manner reduces turbulence in and around the enclosed region 86. Turbulence can cause poor print quality because the main ink drops and the smaller associated satellite drops can be mis-directed by the turbulent air. The substrate 52 passes through an inlet gap 88 and an outlet gap 90 on top of a substrate support structure 62 (e.g. non-porous platen). The platen is preferably non-porous because porous platens may generate too much drag as substrate 52 under high pressure is pulled past the platen. Inlet gap 88 and outlet gap 90 are be from about 0.002 inch to about 0.04 inch, measured above substrate 52. If the gaps become too large, power requirements may become restrictive, and, if the gaps become too small, the image may become smeared or there might be a paper jam. If pressures are too low, rectified diffusion can potentially occur, and if the pressures are too high, structural requirements for the enclosure structure 80 may become prohibitive. Preferably, the static pressure is from about 1.5 atm to about 10 atm absolute (0.5–9 atm above ambient). Droplet ejection assembly 60 includes pumping chambers 92 with connected ink paths 94. Ink paths 94 are connected by an ink inlet 96, connected to ink reservoir 98 holding ink 100. The entire ink reservoir 98 is maintained at the static pressure. This is achieved by small apertures 103 in ink reservoir 98. Minor differences (e.g. 0.1–0.3 psi) within the pumping chambers 92 due to ink reservoir height differences relative to pumping chambers 92 are corrected with pump 102 (e.g., a small centrifugal blower type pump). Water or other solvent may be added to the gas to suppress drying in the nozzle. The gas may be air or the gas may have a reduced oxygen content relative to air to slow the aging of the ink. Increasing the oxygen content relative to air can slow the curing of UV curable ink. In addition, the gas may be filtered, for example with a HEPA filter, to remove particulate matter and excessive moisture.

Figure 6:
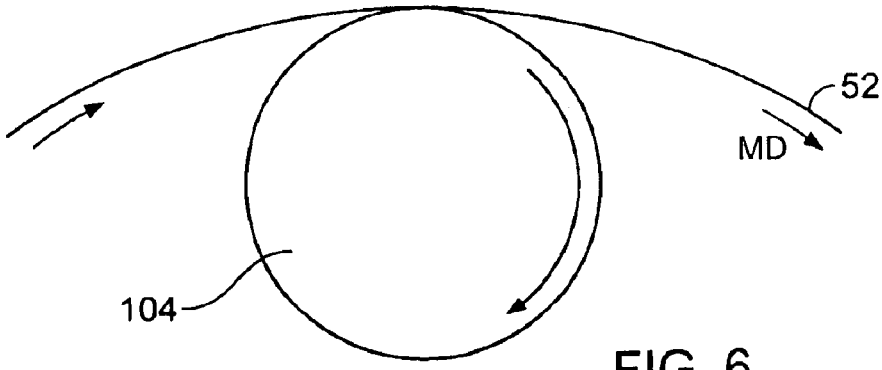
FIG. 6 is a side view of an alternative embodiment.

FIG. 6 illustrates an alternative embodiment employing a rotating drum 104 under printing substrate 52 which replaces stationary, curved support 62 under enclosure 80 in the FIG. 5 apparatus.

Figure 7:
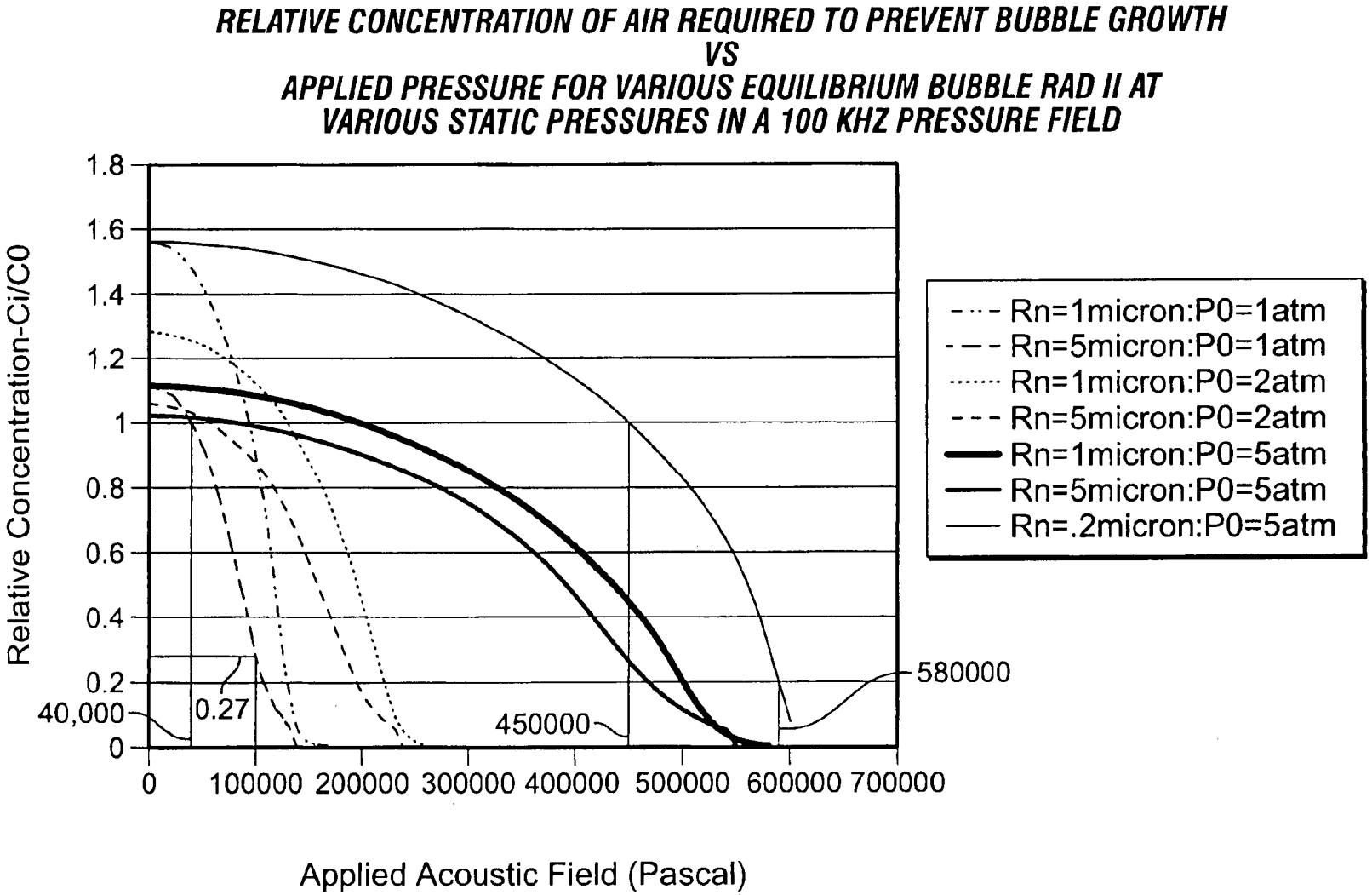
FIG. 7 is a graph of relative concentration versus applied acoustic field.

FIG. 7 is a graph of Relative Concentration (Ci/C0) vs. Applied Acoustic Pressure and shows the relative concentration of air required to prevent bubble growth vs. applied acoustic pressure for various equilibrium bubble radii and various static pressures in a 100 kHz pressure field. Ci is the concentration of air in the ink and C0 is the concentration of air in the ink when it is saturated. The quantity 100(Ci/C0) represents the percent saturation. If the ink is left in contact with air for a long period of time, the ratio Ci/C0 will go to 100% saturation. In many ink jet systems, the ink is degassed prior to use to avoid bubble problems. Degassing the ink lowers the relative concentration values permitting one to operate at higher applied acoustic fields without bubble growth. Increasing the static pressure also permits operation at higher applied acoustic pressures without bubble growth. In the graph, P0 is the static pressure. The x-axis shows the amplitude of the acoustic pressure field. A bubble of a given size will either grow or shrink in a given static pressure, applied acoustic pressure field, and relative concentration of air in ink. Increasing the static pressure, reducing the relative concentration of air in the ink and reducing the amplitude of the oscillating applied pressure field moves things in the direction of making bubbles shrink. As an example, the curve labeled Rn=5 micron:P0=1 atm is for a bubble with an equilibrium radius (i.e. radius with no acoustic pressure applied) of 5 microns and a static pressure of 1 atm. This curve shows that applying an acoustic field of (+/−) 40,000 Pascal, the bubble will not grow even if the relative concentration is 100% (Ci/C0=1). If we wanted this bubble not to grow in a (+/−) 100,000 Pascal pressure field, we would need to reduce the relative concentration to about 27%. As another example, the curve labeled Rn=0.2 micron:P0=5 atm is for a bubble with an equilibrium radius (i.e. radius with no acoustic pressure applied) of 0.2 microns and a static pressure of 5 atm.

For conditions above a curve, the bubble will grow over time, for conditions below the curve the bubble will shrink. Of all the situations illustrated in FIG. 7, the Rn=0.2 microns:P0=5 atm will be the least prone to bubble growth due to rectified diffusion. In this case, bubbles in the ink that is saturated with air (Ci/C0=1) will not grow until the applied acoustic field exceeds 450000 Pascal. By deaerating the ink to a relative concentration of 0.2, an acoustic pressure field of over 580000 Pascal can be applied without bubble growth. FIG. 7 shows that reducing the relative concentration Ci/C0 has a limited effect. For example, for nucleation site sizes of Rn=1 to Rn=5 microns, the maximum acoustic field that can be applied in the jet is about 150,000 Pascal, even if Ci/C0 is reduced to 1%, which is difficult. In contrast, by increasing the static pressure, we can apply four times higher acoustic fields without causing bubble growth. Henry's Law states that the solubility of a gas in a liquid is directly proportional to the pressure of the gas in contact with the liquid. Therefore, when the air pressure over the ink is increased from 1 to 5 atmospheres, the relative concentration is reduced by a factor of 5. If ink that is at 100% saturation with 1 atmosphere is pumped into the reservoir where it is now at 5 atmospheres, then Ci/C0=20%. Of course, measures are taken so that the ink gets into the pumping chamber without re-equilibrating to 100% saturation. Re-equilibration can be avoided by minimizing the surface area of the jetting fluid that is in contact with air and/or by jetting the fluid at a fast enough rate to prevent re-equilibration.

A number of embodiments of the invention have been described. Nevertheless, it will be understood that various modifications may be made without departing from the spirit and scope of the invention. For example, the deposited droplets can be ink or other materials. For example, the deposited droplets may be a UV or other radiation curable material or other material capable of being delivered as droplets. For example, the apparatus described could be part of a precision dispensing system. Accordingly, other embodiments are within the scope of the following claims.

What is claimed is:

1. An apparatus for depositing droplets on a substrate, the apparatus comprising:

a support for said substrate;

a droplet ejection assembly positioned over said support for depositing said droplets on said substrate on said support, said droplet ejection assembly comprising a pumping chamber, a displacement member and an orifice that ejects said droplets;

a controller to provide signals to the displacement member to eject drops; and a source of static pressure to raise the total pressure in said pumping chamber above a threshold pressure level to avoid rectified diffusion type bubble growth in said pumping chamber.

2. The apparatus of claim 1 wherein said static pressure is greater than about 1.5 atmospheres absolute.

3. The apparatus of claim 1 wherein said signals are provided at a frequency of greater than about 8,000 Hz.

4. The apparatus of claim 1 wherein said static pressure is greater than about 1.5 atmospheres absolute and said frequency is greater than about 8000 Hz.

5. The apparatus of claim 1 wherein said droplets comprise ink.

6. The apparatus of claim 1 wherein said substrate comprises paper.

7. The apparatus of claim 1 further comprising a continuously moving support.

8. The apparatus of claim 1 wherein the source of static pressure comprises a pressurized gas.

9. The apparatus of claim 8 further comprising filtering said pressurized gas to remove particulate matter.

10. The apparatus of claim 8 further comprising adding moisture to said source of pressurized gas.

11. The apparatus of claim 8 further comprising adding solvent to said source of pressurized gas.

12. The apparatus of claim 8 wherein the gas is air.

13. The apparatus of claim 8 wherein the gas has an oxygen content less than that of air.

14. The apparatus of claim 8 wherein the gas has an oxygen content greater than that of air.

15. An apparatus for depositing droplets on a substrate, the apparatus comprising:

a support for said substrate;

a droplet ejection assembly positioned over said support for depositing said droplets on said substrate on said support, said droplet ejection assembly comprising a pumping chamber, a displacement member and an orifice that ejects said droplets;

a controller to provide signals to the displacement member to eject drops;

an enclosure structure defining with said support an enclosed region through which said droplets are ejected onto said substrate, said enclosure structure also defining with said support an inlet gap and an outlet gap through which said substrate travels; and a source of static pressure to raise the total pressure in said pumping chamber above a threshold pressure level to avoid rectified diffusion type bubble growth in said pumping chamber.

16. The apparatus of claim 15 wherein said static pressure is greater than about 1.5 atmospheres absolute.

17. The apparatus of claim 15 wherein said signals are provided at a frequency of greater than about 8,000 Hz.

18. The apparatus of claim 15 wherein said static pressure is greater than about 1.5 atmospheres absolute and said frequency is greater than about 8000 Hz.

19. The apparatus of claim 15 wherein said droplets comprise ink.

20. The apparatus of claim 15 wherein said substrate comprises paper.

21. The apparatus of claim 15 further comprising a continuously moving support.

22. The apparatus of claim 15 wherein the source of static pressure comprises a pressurized gas.

23. The apparatus of claim 22 further comprising filtering said pressurized gas to remove particulate matter.

24. The apparatus of claim 22 further comprising adding moisture to said source of pressurized gas.

25. The apparatus of claim 22 further comprising adding solvent to said source of pressurized gas.

26. The apparatus of claim 22 wherein the gas is air.

27. The apparatus of claim 22 wherein the gas has an oxygen content less than that of air.

28. The apparatus of claim 22 wherein the gas has an oxygen content greater than that of air.

29. The apparatus of claim 15 wherein said inlet gap is from about 0.002 inch to about 0.04 inch.

30. The apparatus of claim 15 wherein the outlet gap is from about 0.002 inch to about 0.04 inch.

* * * * *